US011040364B2

(12) United States Patent
Langlois et al.

(10) Patent No.: US 11,040,364 B2
(45) Date of Patent: Jun. 22, 2021

(54) DUAL DISPENSER

(71) Applicant: APTAR FRANCE SAS, Le Neubourg (FR)

(72) Inventors: Yann Langlois, Tilleul Dame Agnes (FR); Alex Milian, Les Baux de Breteuil (FR); Timothee Haquet, Vitot (FR)

(73) Assignee: APTAR FRANCE SAS, Le Neubourg (FR)

( * ) Notice: Subject to any disclaimer, the term of this patent is extended or adjusted under 35 U.S.C. 154(b) by 5 days.

(21) Appl. No.: 16/623,996

(22) PCT Filed: Jun. 26, 2018

(86) PCT No.: PCT/FR2018/051543
§ 371 (c)(1),
(2) Date: Dec. 18, 2019

(87) PCT Pub. No.: WO2019/002742
PCT Pub. Date: Jan. 3, 2019

(65) Prior Publication Data

US 2020/0171523 A1 Jun. 4, 2020

(30) Foreign Application Priority Data

Jun. 30, 2017 (FR) ..... 1756112

(51) Int. Cl.
*B05B 11/00* (2006.01)

(52) U.S. Cl.
CPC ..... *B05B 11/3008* (2013.01); *B05B 11/3083* (2013.01); *B05B 11/3084* (2013.01)

(58) Field of Classification Search
CPC ... B05B 11/3008; B05B 11/3083–3084; F04B 1/02; F04B 23/04; F04B 23/06;
(Continued)

(56) References Cited

U.S. PATENT DOCUMENTS 1,494,381 A * 5/1924 Sebring ..... B05B 11/3008 74/503
4,871,092 A * 10/1989 Maerte ..... B05B 11/3008 222/153.13

(Continued)

FOREIGN PATENT DOCUMENTS

DE 39 11 089 A1 10/1990
FR 2 909 982 A1 6/2008

(Continued)

OTHER PUBLICATIONS

International Search Report for PCT/FR2018/051543 dated Oct. 5, 2018 [PCT/ISA/210].

(Continued)

*Primary Examiner* — Patrick M. Buechner
*Assistant Examiner* — Randall A Gruby
(74) *Attorney, Agent, or Firm* — Sughrue Mion, PLLC

(57) ABSTRACT

A dual dispenser having two pumps (P1, P2) associated with two reservoirs, each pump having a pump body (P10, P20) and an actuator rod (P11, P21) axially movable over an axial stroke; and a dispenser head including a dispenser orifice (O) for dispensing the fluids coming from the actuator rods (P11, P21). The dispenser head has a cap (1) mounted on the actuator rods (P11, P21) and that forms the dispenser orifice (O); a pusher (2) mounted on the cap (1) so as to move it axially downwards and upwards, the pusher (2) also being mounted on the cap (1) so as to turn relative thereto; and an adjustment insert (3) arranged below the cap (1) and that is secured to the pusher (2) to turn with it, the cap (1) coming into abutment against the adjustment insert (3), limiting the axial stroke of the actuator rods (P11, P21).

11 Claims, 6 Drawing Sheets

(58) Field of Classification Search
CPC ..... F04B 27/005; F04B 49/12; F04B 49/14; F04B 2201/0206
See application file for complete search history.

(56) References Cited

U.S. PATENT DOCUMENTS

| | | | | |
|---|---|---|---|---|
| 6,464,107 | B1 | 10/2002 | Brugger | |
| 8,418,887 | B2 * | 4/2013 | Milian | B05B 11/0038 222/137 |
| 9,346,069 | B2 * | 5/2016 | Holzmann | B05B 11/3056 |
| 9,925,550 | B2 * | 3/2018 | Dring | B05B 11/3001 |
| 2004/0251274 | A1 | 12/2004 | Ponton | |
| 2006/0037974 | A1 | 2/2006 | Brugger | |

FOREIGN PATENT DOCUMENTS

| | | | |
|---|---|---|---|
| WO | 2010/003091 | A1 | 1/2010 |
| WO | 2014/067593 | A1 | 5/2014 |

OTHER PUBLICATIONS

International Preliminary Report on Patentability with a Translation of Written Opinion in International Application No. PCT/FR2018/051543, dated Dec. 31, 2019.

* cited by examiner

DUAL DISPENSER

CROSS REFERENCE TO RELATED APPLICATIONS

This application is a National Stage of Application No. PCT/FR2018/051543 filed Jun. 26, 2018, claiming priority based on French Patent Application No. 1756112 filed Jun. 30, 2017.

The present invention relates to a dual dispenser comprising two pumps each associated with a respective one of two fluid reservoirs. Each of the two pumps comprises a stationary pump body and an actuator rod that is axially movable over an axial stroke. The dual dispenser also includes a common dispenser head having an outlet channel that forms a dispenser orifice for dispensing the fluids coming from the actuator rods of both pumps. The advantageous fields of the invention are the fields of cosmetics and of pharmacy.

In the prior art, adjustable-dose dual dispensers are already known. In a widespread embodiment, the dispenser comprises a rotary ring that internally forms a ramp or annular steps that serve as an axial abutment for a pusher, thereby limiting the actuation stroke and consequently the dose of fluid that is dispensed. Rings having a ramp make it possible to vary doses continuously, and rings having steps make it possible to vary doses in steps. The outside of the rotary ring forms a grip member that the user can grip so as to turn the ring. Markings or sliders are provided on the rotary ring or in direct proximity thereof so as to inform the user about the precise position of the ring, and thus about the adjusted dose settings.

The present invention seeks to define a dual dispenser in which the adjustment of doses is more discreet by eliminating the rotary grip ring that is clearly visible and that makes the dispenser look very technical. In other words, an object of the invention is to preserve a rotary ring that is suitable for limiting the heights of the strokes of the actuator rods, but that makes the grip member as discreet as possible. An object of the invention is to combine the grip member with another member of the dispenser so as to incorporate it seamlessly.

To do this, the present invention proposes that the common dispenser head comprises:

- a cap that is mounted on the actuator rods and that forms the dispenser orifice;
- a pusher that is mounted on the cap so as to move it axially downwards and upwards, the pusher also being mounted on the cap so as to turn relative thereto; and
- an adjustment insert that is arranged below the cap and that is secured to the pusher in such a manner as to turn with it, the cap coming into abutment against the adjustment insert, thereby limiting the axial stroke of the actuator rods.

Thus, it is the rotary pusher that performs the additional function of a grip member for gripping and actuating the adjustment insert. It can also be said that the stroke-limiting function and actuation function are separate functions, with the limiting function being provided by the adjustment insert, and the function of actuating the adjustment insert being provided by the pusher. The actuator member of the adjustment insert is combined with the pusher, which, in conventional manner, has as its main function actuating the actuator rods of the pumps. As a result, it is possible to mask or to conceal the actuator member of the adjustment insert completely, giving little information, if any, about the additional function of the pusher. The dispenser may thus present a conventional configuration, namely that of a dispenser comprising only one reservoir and only one pump.

Advantageously, the cap presses the adjustment insert against the pump bodies at the end-of-stroke of the pusher. Thus, the adjustment insert is sandwiched between the cap and the pump bodies.

In an advantageous embodiment, the adjustment insert includes an adjustment plate that forms two through openings for passing both actuator rods. The adjustment plate is sandwiched between the cap and the pump bodies. Advantageously, the through openings are bordered by abutment areas having axial heights that are different. Preferably, the adjustment plate presents different wall thicknesses at the abutment areas. The through openings may present a kidney shape.

In another advantageous aspect of the invention, the adjustment insert is connected to the pusher via an axial pin that passes through the cap, the pusher forming a housing in which the axial pin is received and prevented from turning. Thus, the cap is interposed between the pusher and the adjustment plate, with the axial pin passing through the cap in central manner. The pusher and the adjustment insert turn together about an axis passing along the axial pin, while the cap that is arranged between them does not turn. The pusher also moves axially, taking the cap with it. Furthermore, the axial pin of the insert can slide, with or without friction, in the housing of the pusher. Advantageously, the axial pin presents a polygonal cross-section that is adapted to cooperate with the housing of the pusher so as to be constrained to turn therewith, and so as to slide axially relative thereto. Turning of the pusher may be limited by the adjustment insert that is engaged around the actuator rods. Advantageously, the cap includes two connection sleeves that come into abutment against the abutment areas. In a variant, the tops of the pump bodies could come into abutment with the abutment areas.

According to another advantageous characteristic, the dispenser orifice is engaged in a slot that is formed by a covering hoop, the dispenser orifice being moved axially in the slot by pressing on the pusher. The pusher may be engaged in the covering hoop, thereby masking the adjustment insert and the cap, except for its dispenser orifice that is engaged in the slot.

The spirit of the invention resides in incorporating or positioning the actuation of the dose adjustment means in a conventional member of the dispenser, and in particular in its pusher, so that the dual dispenser still has the conventional configuration of a single dispenser (one reservoir and one pump). Connecting the pusher to the adjustment insert through the cap constitutes an advantageous characteristic.

The invention is described below in greater detail with reference to the accompanying drawings, which show an embodiment of the invention by way of non-limiting example.

Figure 1:
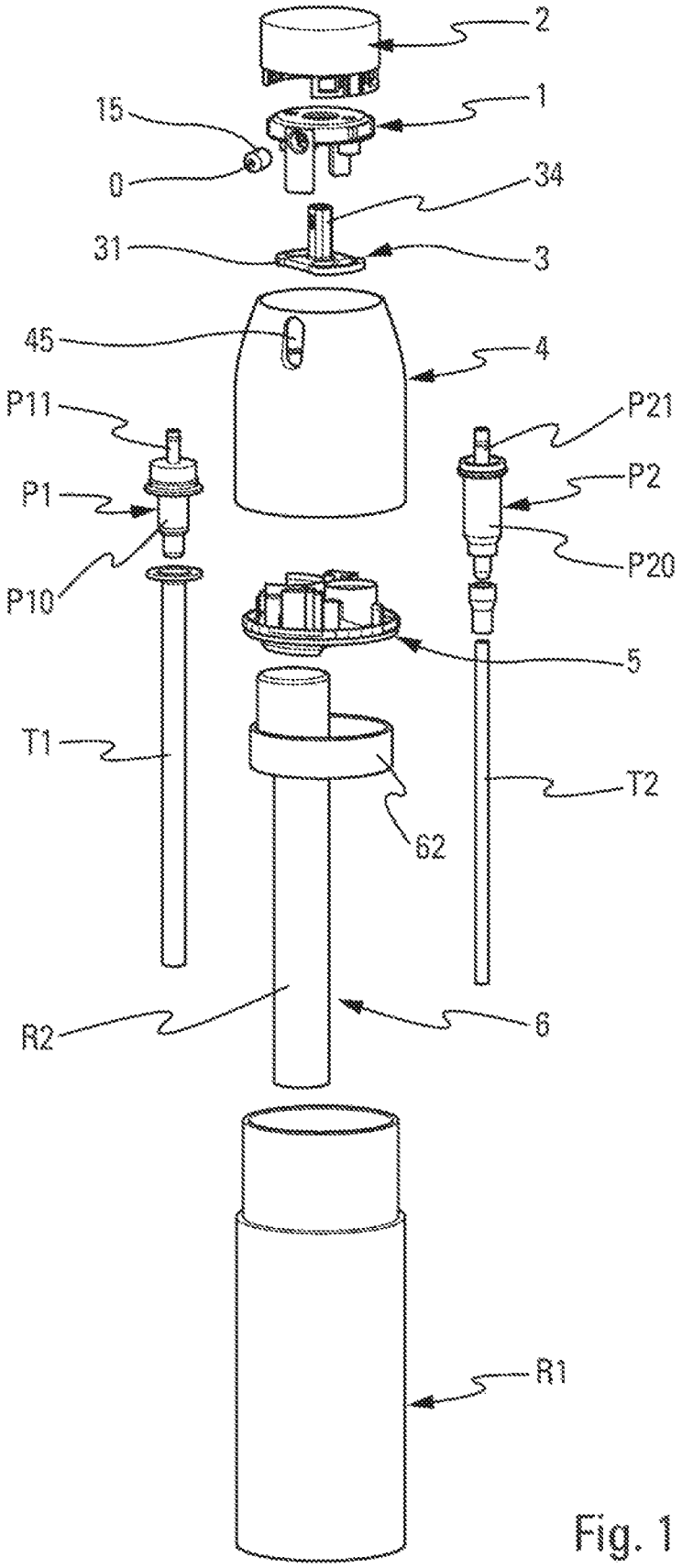
FIG. 1 is an exploded perspective view of a dual dispenser of the invention.

Reference is made firstly to FIG. 1 in order to describe in detail all of the component elements of the dispenser of the invention. Very briefly, the dispenser comprises a main reservoir R1 that forms an outer shell, a casing 6 that forms a secondary reservoir R2 (FIGS. 6 and 7), a cover 5 that is mounted on both of the reservoirs R1 and R2 and that serves to support two pumps P1 and P2 that are provided with respective dip tubes T1 and T2. Each pump comprises a pump body P10, P20, and an actuator rod or valve rod P11, P21 that slides axially downwards and upwards. The top portion of the dispenser comprises a cap 1 that is mounted on the free ends of both valve rods P11, P21, and that defines an internal channel that leads to a nozzle 15 forming a dispenser orifice O. The top portion of the dispenser also comprises a pusher 2 that is mounted on the cap 1 so as to move it axially by pressing the valve rods P11, P21. The top portion of the dispenser also comprises a covering hoop 4 that is mounted on the main reservoir R1 so as to mask all of the component elements, except for the pusher 2 and the nozzle 15. In the invention, the top portion of the dispenser also comprises an adjustment insert 3 that makes it possible to vary the strokes of the actuator rods P11, P21, and thus the doses of fluid dispensed by the pumps P1, P2. This is the general structure of the dispenser in this embodiment of the invention.

Figure 2:
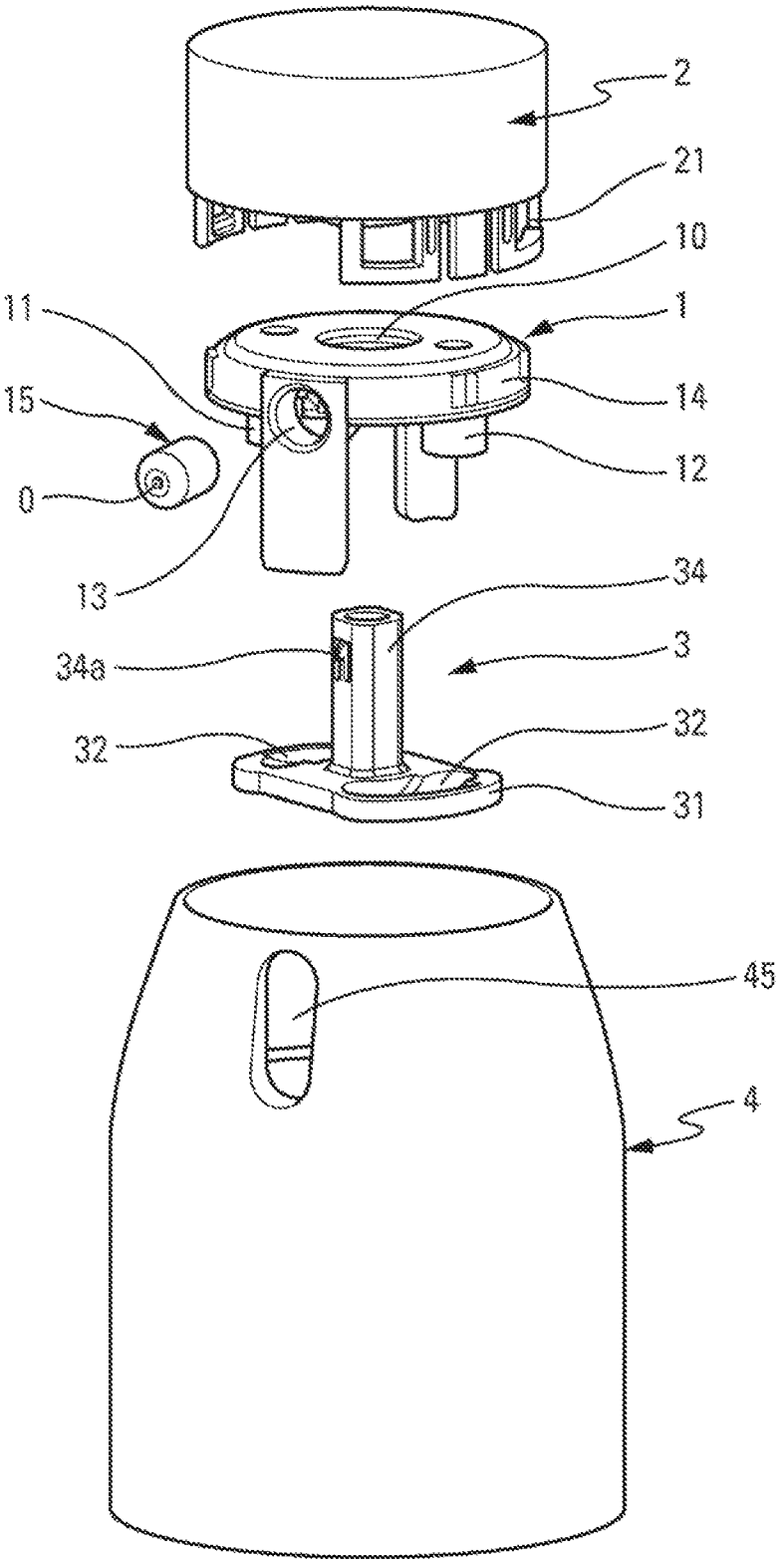
FIG. 2 is a very greatly enlarged view of a portion of FIG. 1.

FIG. 2 shows only the top portion of the dispenser comprising the cap 1, the pusher 2, the adjustment insert 3, and the covering hoop 4. The pusher 2 includes fastener means 21 for co-operating with fastener profiles 14 formed by the cap 1. Thus, the pusher 2 is constrained to move axially with the cap 1. However, the pusher 2 is free to turn relative to the cap 1.

The cap 1 includes two connection sleeves 11 and 12 that are adapted to come into engagement on the free ends of the actuator rods P11 and P21 of the two pumps. Although not shown, an internal channel connects the two connection sleeves 11 and 12 to a nozzle housing 13 that opens out sideways. The nozzle housing 13 receives a nozzle 15 that forms a dispenser orifice O. The nozzle 15 can dispense the mixture of fluid in various forms: spray, thread, glob, etc. The cap 1 also includes a vertical axial central passage 10 that extends substantially between the two connection sleeves 11 and 12.

The adjustment insert 3 includes an adjustment plate 31 that forms two through openings 32 for passing the two actuator rods P11, P21. The adjustment insert 3 also includes an axial pin 34 that extends upwards from the adjustment plate 31. The axial pin 34 presents a cross-section of polygonal shape, or of any other shape that makes it possible to prevent it from turning. The axial pin 34 may be provided with one or more snap-fastener profiles 34*a*.

In this embodiment, the covering hoop 4 presents a bullet shape that is not limiting. The hoop is pierced with an oblong slot 45 for receiving the nozzle 15. The vertical oblong shape makes it possible for the nozzle 15 to move axially while pressing on the pusher 2.

Figure 3:
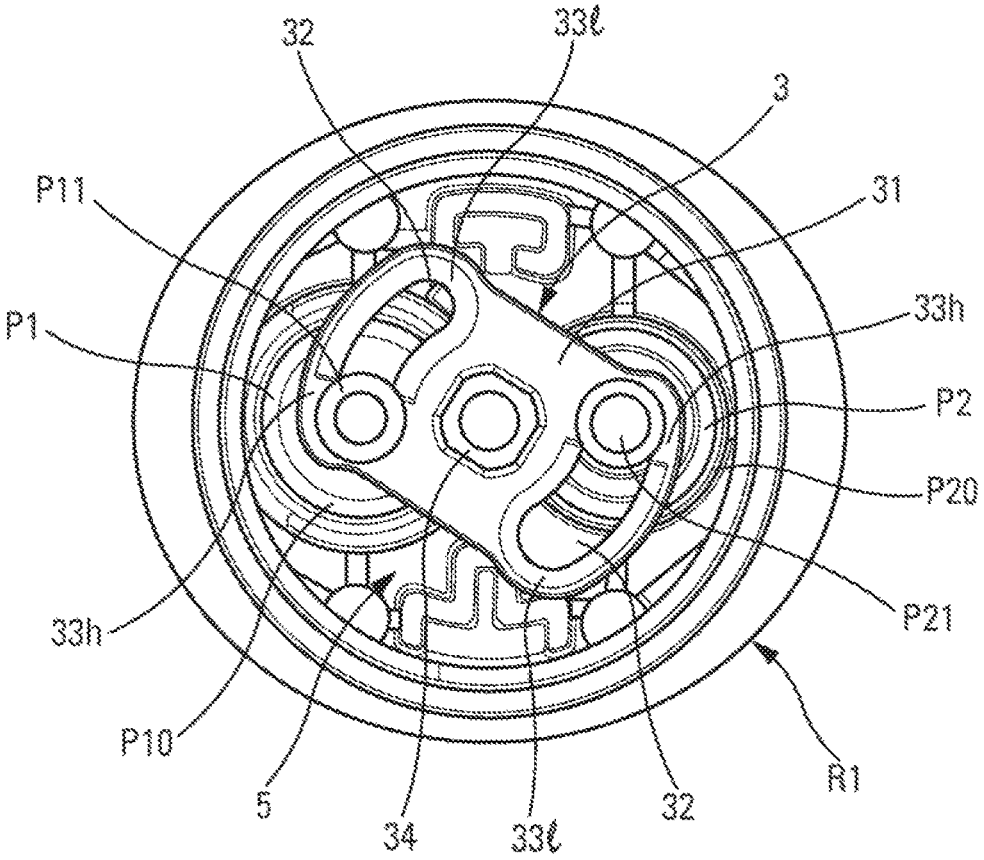
FIG. 3 is a plan view of the dispenser in FIGS. 1 and 2 with the cap and the pusher removed.
Figure 4:
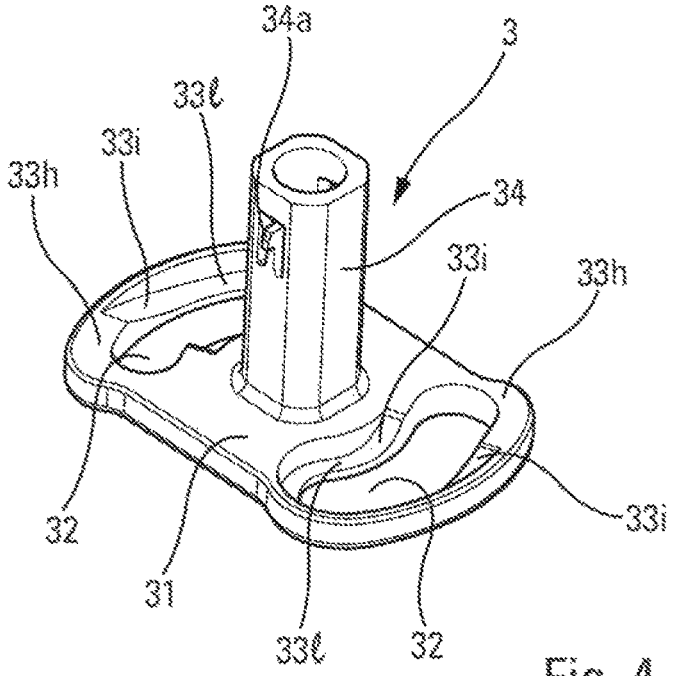
FIG. 4 is a perspective view of the adjustment insert of the invention.

Reference is made below to FIGS. 3 and 4 in order to explain in detail the structure of the adjustment insert 3 and its co-operation with the valve rods P11 and P21. As mentioned above, both valve rods P11 and P21 extend through the through openings 32 that are formed by the adjustment plate 31 of the adjustment insert 3. It should be observed that the through openings 32 are arranged symmetrically about the axial pin 34, and advantageously they present a kidney shape. It can easily be understood that the adjustment plate 31 can be moved in turning about a vertical axis that passes along the axial pin 34, such that the actuator rods P11 and P21 move inside the through openings 32. It should also be observed that the through openings 32 are bordered by abutment areas 33*h*, 33*l*, and 33*i* having axial heights that are different. This can be seen more clearly in FIG. 4. The intermediate abutment areas 33*i* form ramps that make it possible to connect the upper abutment areas 33*h* to the lower abutment areas 33*l*. Thus, for a single through opening 32, the abutment areas are connected together so as to form a continuous closed loop that defines the edge of the through opening 32. The upper abutment areas 33*h* correspond to a maximum thickness of the adjustment plate 31, while the lower abutment areas 33*l* correspond to a minimum thickness of the adjustment plate 31. Thus, depending on how they are positioned in the through openings 32, the valve rods P11 and P21 are either bordered mainly by the upper abutment areas 33*h*, or they are bordered mainly by the lower abutment areas 33*l*.

Figure 5:
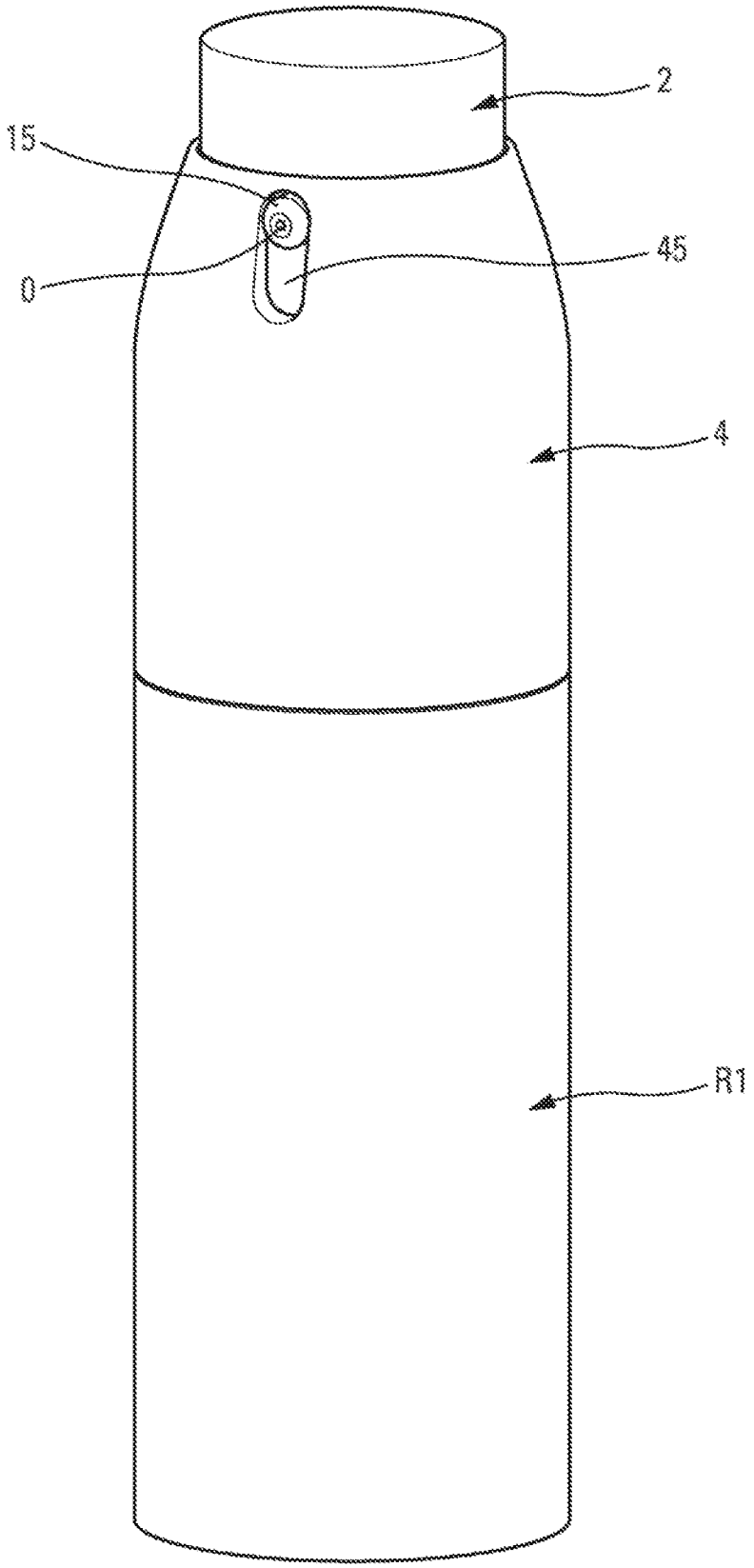
FIG. 5 is a perspective view of the dispenser of the above figures, shown in its mounted state.

In FIG. 5, the dispenser can be seen in its mounted state, in which only the main reservoir R1, the covering hoop 4, the pusher 2, and the nozzle 15 positioned in the oblong slot 45 in the covering hoop 4, are visible. By pressing on the pusher 2, the nozzle 15 is moved axially in the oblong slot 45 and it dispenses a mixture of fluids.

Figure 6:
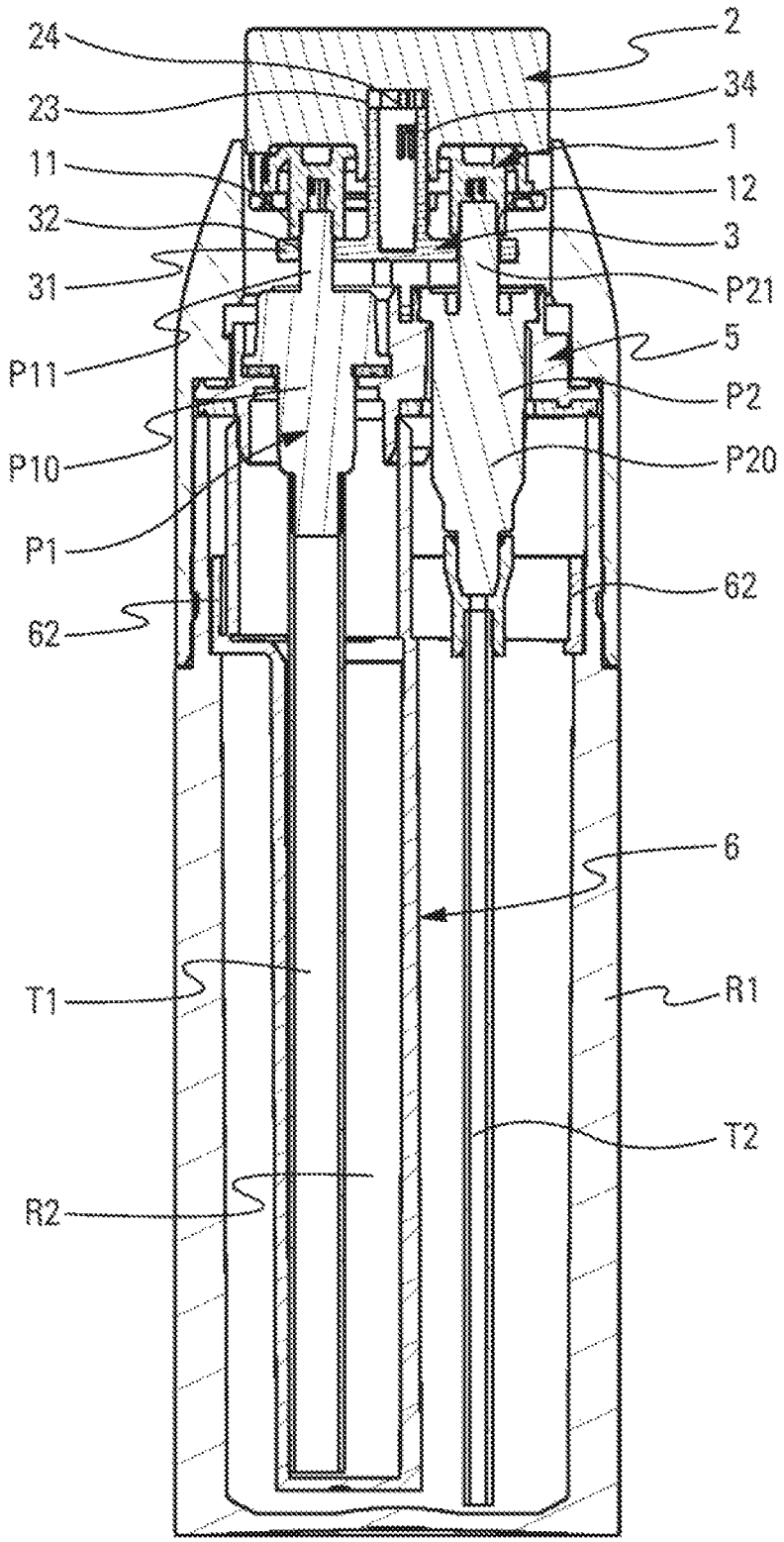
FIGS. 6 and 7 are vertical-section views through the dispenser of the above views, respectively in its rest position and in its pressed position.

With reference to FIG. 6, it should immediately be observed that the cap 1 is interposed between the pusher 2 and the adjustment plate 31 of the adjustment insert 3. The axial pin 34 of the adjustment insert 3 passes through the vertical axial central passage 10 of the cap 1 and comes to be engaged inside a housing 23 that is formed in the pusher 2. The housing 23 presents a cross-section that co-operates with the axial pin 34 of polygonal cross-section, in such a manner as to prevent any relative turning between the pusher 2 and the adjustment insert 3. By way of example, the pin 34 and the housing 23 may present a section that is square, hexagonal, or cross- or star-shaped. The pin 34 is thus prevented from turning in the housing 23, such that the adjustment insert is constrained to turn with the pusher 2. However, the pin 34 can slide axially, freely or with a little friction, in the housing 23 over a small axial stroke that can be limited by the snap-fastener profile 34*a*. This is why a small amount of clearance 24 can be seen in the housing 23 above the axial pin 34. The cap 1 is mounted so that it does not turn, because it is engaged on the actuator rods P11 and P21. Thus, the pusher 2 and its adjustment insert 3 can turn about a vertical axis that passes along the axial pin 34, over an angular stroke that is limited by the through openings 32. In this non-limiting embodiment, the angle through which the pusher and the insert can turn lies in the range about 45° to about 60°. Naturally, the angle may be varied by modifying the shape, or more particularly the length, of the through openings 32.

It should be observed that the connection sleeves 11 and 12 come into contact or into abutment with the top face of the adjustment plate 31 at the abutment areas that border the through openings 32. In FIG. 6, the connection sleeves 11 and 12 come into abutment with the upper abutment areas 33*h* that correspond to the maximum thickness of the adjustment plate 31. In FIG. 6, which corresponds to the rest state, the actuator rods P11 and P21 are extended as far as possible, such that the adjustment plate 31 is arranged at a distance from the pump bodies P10 and P20.

It should be understood that by turning the pusher 2, the adjustment insert is turned, thereby moving the through openings 32 relative to the valve rods P11, P21. Starting from the position shown in FIG. 6 that corresponds to the valve rods P11, P21 being situated at the upper abutment areas 33*h*, the pusher can be turned so as to bring the valve rods P11 and P21 to the lower abutment areas 33*l*.

Figure 7:
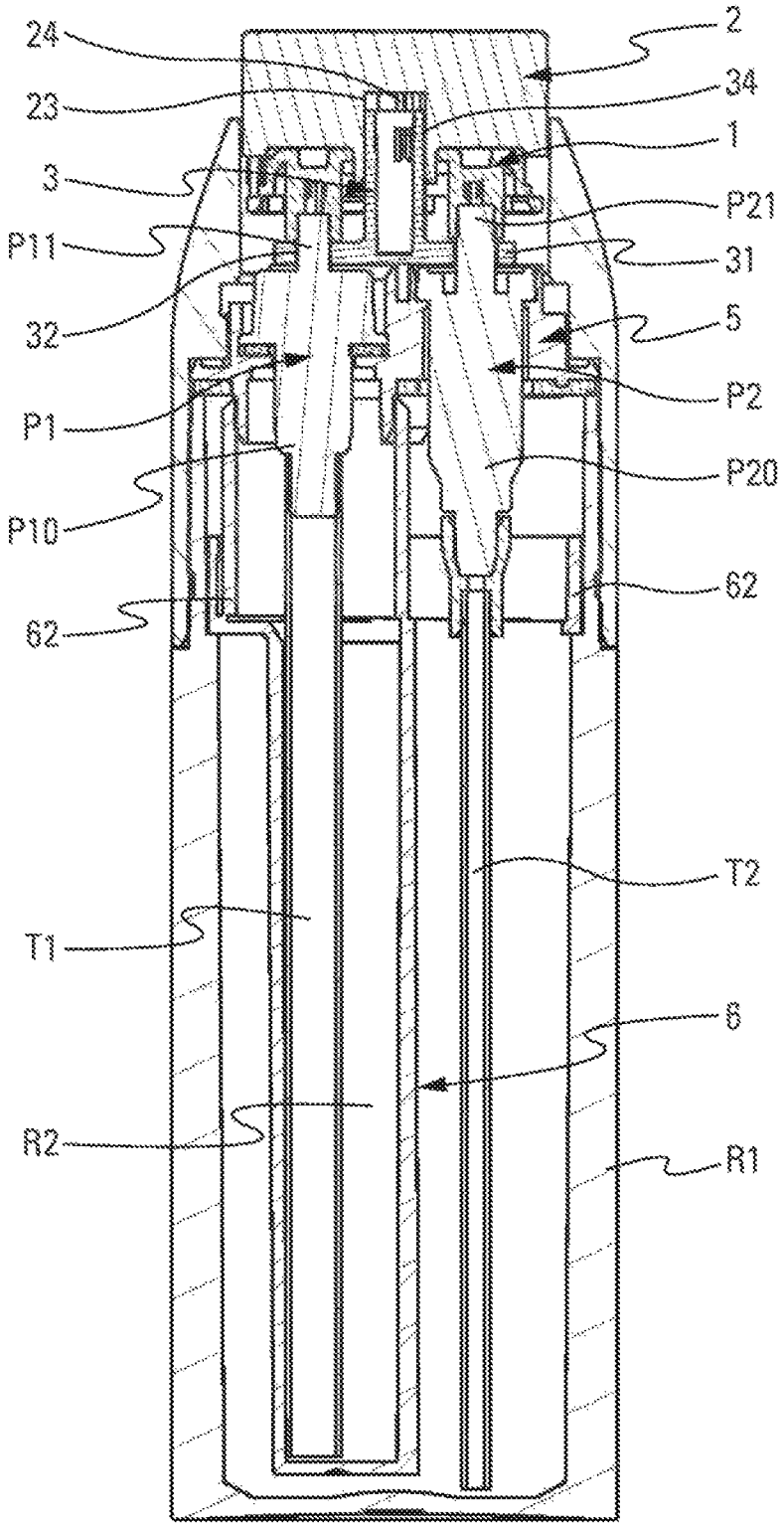

In FIG. 7, the dispenser is in a pressed or actuated state that corresponds to the pusher 2 being pressed axially. The assembly formed by the pusher 2, the insert 3, and the cap 1 has moved downwards by pressing down the valve rods P11 and P21. It should be observed that the adjustment plate 31 is thus in abutment against the pump bodies P10 and P20. As a result of the adjustment plate 31 being interposed between the connection sleeves 11, 12 and the pump bodies P10, P20, the valve rods P11 and P21 are not pressed down fully, thereby limiting the axial stroke of the valve rods, and thereby reducing the volume of the dose of fluid that is dispensed. The adjustment plate 31 thus acts as a spacer between the sleeves 11, 12 and the pump bodies P10 and P20. By turning the pusher 2 and, as a result, the adjustment plate 31, it is possible to increase the volume of the doses that are dispensed by positioning the lower abutment areas 33*l* around the connection sleeves 11, 12. The sleeves can thus penetrate into the adjustment plate 31 until they come into abutment with the lower abutment areas 33*l*. This requires the adjustment insert 3 to move a little relative to the pusher 2, which is made possible by the small amount of clearance 24 that is situated at the top of the housing 23 and into which the axial pin 34 can penetrate.

It is thus possible to vary the doses of fluid that are dispensed, very simply by turning the pusher 2. It can thus be said that the actuator member of the adjustment insert 3 is formed or constituted by the pusher 2. This makes it possible for the dispenser to have a configuration that is entirely conventional, as can be seen in FIG. 5. Specifically, the dispenser does not make it apparent that it has two reservoirs and two pumps, and furthermore, it does not have a specific actuator member for adjusting the doses of fluid that are dispensed, given that it is the pusher 2 that performs this function.

In the figures, the abutment areas 33*h*, 33*l*, 33*i* are situated on the same side as the axial pin 34. In a variant, the abutment areas could be situated on the opposite side of the adjustment plate and could co-operate with the top portions of the pump bodies P10, P11 or with washers engaged around the valve rods and bearing against the top portions of the pump bodies P10, P11.

In the figures, the adjustment plate 31 forms two stable abutment areas, namely the upper area 33*h* and the lower area 33*l*. Without going beyond the ambit of the invention, the adjustment plate 31 could form more than two stable abutment areas, e.g. providing one or more stable intermediate areas instead of the unstable intermediate area 33*i*.

In the embodiment described, there is a dispenser orifice in common. However, it is possible to envisage a dispenser orifice having two fluid outlets, but without that going beyond the ambit of the invention.

In FIGS. 6 and 7, it can also be seen that the casing 6 forms the secondary reservoir R2 together with a sleeve 62 that bears against an internal shoulder of the reservoir R1. Thus, the dip tube T1 draws a fluid contained in the secondary reservoir R2, while the dip tube T2 draws directly from the main reservoir R1 so as to dispense another fluid that is advantageously different from the fluid in the secondary reservoir R2. The cover 5 is mounted both on the casing 6 and on the main reservoir R1 and supports both pump bodies P10 and P20 in stable and leaktight manner. These characteristics are not in any way limiting for the invention.

The invention thus provides a dual dispenser for dispensing a dose that is adjustable by means of the pusher. This makes it possible to make a dual dispenser having the appearance of a single dispenser that comprises only one reservoir, one pump, and one pusher. As a function of information marked on the dispenser, the user is made aware to a greater or lesser extent about the additional function of the pusher.

The invention claimed is:

1. A dual dispenser comprising:

two pumps (P1, P2) associated with two fluid reservoirs, each of the two pumps (P1, P2) comprising a pump body (P10, P20) and an actuator rod (P11, P21) that is axially movable over an axial stroke; and a dispenser head including a dispenser orifice (O) for dispensing the fluids coming from the actuator rods (P11, P21) of both pumps (P1, P2);

wherein the dispenser head comprises:

a cap (1) that is mounted on the actuator rods (P11, P21) and that forms the dispenser orifice (O);

a pusher (2) that is mounted on the cap (1) so as to move it axially downwards and upwards, the pusher (2) also being mounted on the cap (1) so as to turn relative thereto; and an adjustment insert (3) that is arranged below the cap (1) and that is secured to the pusher (2) in such a manner as to turn with it, the cap (1) coming into abutment against the adjustment insert (3), thereby limiting the axial stroke of the actuator rods (P11, P21).

2. A dispenser according to claim 1, wherein the cap (1) presses the adjustment insert (3) against the pump bodies (P10, P20) at the end-of-stroke of the pusher (2).

3. A dispenser according to claim 1, wherein the adjustment insert (3) includes an adjustment plate (31) that forms two through openings (32) for passing both actuator rods (P11, P21).

4. A dispenser according to claim 3, wherein the through openings (32) are bordered by abutment areas (33*h*, 33*l*, 33*i*) having axial heights that are different.

5. A dispenser according to claim 4, wherein the cap (1) includes two connection sleeves (11, 12) that come into abutment against the abutment areas (33*h*, 33*l*, 33*i*).

6. A dispenser according to claim 1, wherein the adjustment insert (3) is connected to the pusher (2) via an axial pin (34) that passes through the cap (1), the pusher (2) forming a housing (23) in which the axial pin (34) is received and prevented from turning.

7. A dispenser according to claim 6, wherein the axial pin (34) presents a polygonal cross-section that is adapted to co-operate with the housing (23) of the pusher (2) so as to be constrained to turn therewith.

8. A dispenser according to claim 7, wherein the axial pin (34) slides in the housing (23).

9. A dispenser according to claim 1, wherein, turning of the pusher (2) is limited by the adjustment insert (3) that is engaged around the actuator rods (P11, P21).

10. A dispenser according to claim 1, wherein the dispenser orifice (O) is engaged in a slot (40) that is formed by a covering hoop (4), the dispenser orifice (O) being moved axially in the slot (40) by pressing on the pusher (2).

11. A dispenser according to claim 10, wherein the pusher (2) is engaged in the covering hoop (4), thereby masking the adjustment insert (3) and the cap (1), except for its dispenser orifice (O) that is engaged in the slot (40).

* * * * *